US008491345B2

(12) United States Patent
Leon et al.

(10) Patent No.: US 8,491,345 B2
(45) Date of Patent: Jul. 23, 2013

(54) ELECTRICAL CONTACT ASSEMBLIES WITH AXIALLY CANTED COIL SPRINGS

(75) Inventors: Gordon Leon, Foothill Ranch, CA (US); Kevin Vu, Foothill Ranch, CA (US)

(73) Assignee: Bal Seal Enginnering, Inc., Foothill Ranch, CA (US)

( * ) Notice: Subject to any disclaimer, the term of this patent is extended or adjusted under 35 U.S.C. 154(b) by 0 days.

(21) Appl. No.: 13/453,944

(22) Filed: Apr. 23, 2012

(65) Prior Publication Data

US 2012/0208407 A1 Aug. 16, 2012

Related U.S. Application Data

(62) Division of application No. 12/691,564, filed on Jan. 21, 2010, now abandoned.

(60) Provisional application No. 61/173,746, filed on Apr. 29, 2009.

(51) Int. Cl.
*H01R 4/48* (2006.01)

(52) U.S. Cl.
USPC ..... 439/817

(58) Field of Classification Search
USPC ..... 439/817, 827, 840; 267/151; 403/225, 403/229, 345
See application file for complete search history.

(56) References Cited

U.S. PATENT DOCUMENTS

2004/0245686 A1 12/2004 Balsells
2005/0178738 A1* 8/2005 Balsells ..... 213/1 R
2005/0234521 A1 10/2005 Balsells
2005/0242910 A1 11/2005 Balsells
2006/0127170 A1* 6/2006 Balsells ..... 403/225
2006/0221625 A1 10/2006 Naviaux et al.
2008/0053811 A1 3/2008 Balsells et al.
2008/0254670 A1 10/2008 Balsells et al.
2009/0185853 A1* 7/2009 Koelling et al. ..... 403/229
2010/0029145 A1* 2/2010 Balsells et al. ..... 439/827
2010/0289198 A1* 11/2010 Balsells et al. ..... 267/151
2010/0304623 A1* 12/2010 Poon et al. ..... 439/840

FOREIGN PATENT DOCUMENTS

EP 0 629 113 A1 12/1994

OTHER PUBLICATIONS

Extended European Search Report from corresponding European Patent Application No. 10153076.4 (7 pages).
Office Action mailed Oct. 18, 2011 from corresponding U.S. Appl. No. 12/691,564.
Final Office Action mailed Jan. 25, 2012 from corresponding U.S. Appl. No. 12/691,564.

* cited by examiner

*Primary Examiner* — Chandrika Prasad
(74) *Attorney, Agent, or Firm* — Klein, O'Neill & Singh, LLP

(57) ABSTRACT

An electrical contact assembly including a housing defining a bore having an internal groove formed therein; an axial canted coil spring having a plurality of spring coils, each spring coil having a spring coil length, the plurality of spring coils disposed in the internal groove with a groove width having a width dimension; wherein at least one spring coil comprises a minor axis length that is greater than the width dimension. An insertion object sized for insertion into the bore of the housing; wherein a clamping force of the axial canted coil spring retains the insertion object within the bore; and wherein the axial canted coil spring provides an electrical conductive path between the insertion object and the housing that is less than 50% of the spring coil length.

20 Claims, 7 Drawing Sheets

ELECTRICAL CONTACT ASSEMBLIES WITH AXIALLY CANTED COIL SPRINGS

CROSS-REFERENCE TO RELATED APPLICATION

This is a divisional application of application Ser. No. 12/691,564, filed Jan. 21, 20120; now abandoned which claims priority to Provisional Application No. 61/173,746, filed Apr. 29, 2009, the contents of each of which are expressly incorporated herein by reference for all purposes.

BACKGROUND

The present disclosure is related to an electrical contact assembly, and more specifically to an electrical contact assembly including canted coil springs for electrical contact applications, particularly with a reduced electrical conductive wire path.

Generally, electrical contact assemblies that use canted coil springs typically include a radially canted coil spring, a housing, and an insertion object, such as a shaft, to form an electrical connector. The radial canted coil spring for this application may be used for holding, latching, or as a locking means and may be made from a conductive material for electrical contact. The electrical conductive path between the insertion object and the housing is created by the radial canted coil spring where the spring serves as a conductor between the two mating parts. Therefore, the path that current must travel between the housing and the insertion object is through the actual wire length of the single spring coil between the insertion object and the spring and between the housing and the spring. Due to the radial spring mount configuration, the spring is mounted radially between the insertion object and the housing, such that the contact points are typically at opposite ends of a spring coil, thus the electrical conductive path is approximately half way around the spring coil.

SUMMARY

The present disclosure is directed to an electrical contact assembly that provides an electrical conductive path with a reduced length to, among other things improve conductivity, reduce heat buildup and increase the current carrying capabilities of the assembly.

In one aspect, an electrical contact assembly is provided including a housing defining a bore having an internal groove formed therein, and an axial canted coil spring comprising a plurality of spring coils, each spring coil having a spring coil length, the plurality of spring coils disposed in the internal groove comprising a groove width with a length; where at least one spring coil comprises a minor axis length that is greater than the length of said groove width in order to retain said spring in said groove. The contact assembly also includes an insertion object sized for insertion into the bore of the housing; where a clamping force of the axial canted coil spring retains the insertion object within the bore; and where the axial canted coil spring provides an electrical conductive path between the insertion object and the housing that is less than 50% of the spring coil length.

In another aspect, an electrical contact assembly is provided including a housing defining a bore comprising an internal groove having a first side wall, a second side wall and a bottom wall therebetween. The contact assembly also includes a canted coil spring disposed in the internal groove and an insertion object sized for insertion into the bore. The canted coil spring having a spring coil having a spring coil length that contacts at least one of the side walls at a first contact point. The canted coil spring contacts the insertion object at an insertion object contact point to retain the insertion object within the bore. An electrical path length between the first contact point and the insertion object contact point is approximately a quarter (¼) of the spring coil length.

In another aspect, a method is provided for assembling an electrical contact assembly including providing a housing defining a bore with an internal groove having a first side wall, a second side wall and a bottom wall; positioning a canted coil spring in the internal groove; inserting an insertion object into the bore to create an electrical path length extending from a first contact point between at least one of the side walls and the canted coil spring and a second contact point between the insertion object and the canted coil spring. The electrical path length between the first contact point and the second contact point is less than half of a length of a spring coil of the canted coil spring.

BRIEF DESCRIPTION OF THE DRAWINGS

The advantages of the present embodiments will appear from the following description when considered in conjunction with the accompanying drawings in which.

DETAILED DESCRIPTION

Figure 1B:
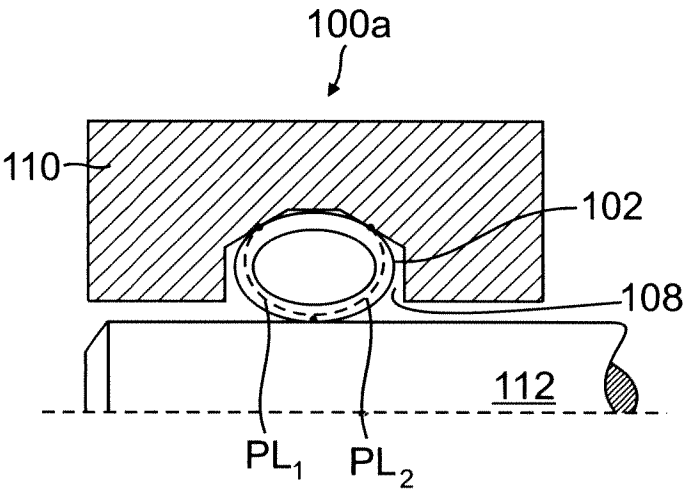
FIG. 1*b* is a simplified cross-sectional illustration showing a housing-mounted radial spring in a V-bottom groove electrical contact assembly in accordance with an embodiment.

The detailed description set forth below in connection with the appended drawings is intended as a description of present embodiments of an electrical contact assembly that uses canted coil springs and where the electrical conductive path between the housing and the shaft is reduced. The disclosure is not intended to represent the only forms in which the present embodiments may be constructed or used. The description sets forth features and steps for constructing and using the electrical contact assembly in connection with the illustrated embodiments. It is to be understood that the same or equivalent functions and structures may be accomplished by different embodiments that are also intended to be encompassed within the spirit and the scope of the present embodiments.

A canted coil spring comprises a plurality of individual spring coils all canted in the same direction. Each coil comprises a coil height corresponding to a minor axis and a coil width corresponding to a major axis. As used herein, a coil height is always the shorter of the two measurements, whether that coil is configured as an axial canted coil spring or a radial canted coil spring, and is the length that is configured to deflect. Also as used herein, a radial canted coil spring has its coil height oriented perpendicularly to the axis of an insertion object while an axial canted coil spring has its coil height oriented parallel to the axis of the insertion object.

The contact assemblies described below include a canted coil spring that has a higher current carrying capability due to reduced heat buildup because of efficient and effective electrical path length between contact points. In certain embodiments, this is accomplished by having a housing defining a bore with an internal groove formed in, on, or around the bore. The canted coil spring is disposed in the internal groove. The internal groove has a groove width that is less than the length of the minor axis of at least one spring coil to provide retention of the spring within the internal groove. Moreover, because the width of the internal groove is less than the length of the minor axis of the spring, the spring must form contact points with the housing on both sides of the spring coil and on both side walls of the internal groove. Thus, by using an axial canted coil spring, spring force is applied against the two side walls of the internal groove thereby increasing the number of contact points as compared to using a radial canted coil spring in the same internal groove.

An insertion object, such as a shaft, a pin, or a rod, is sized for insertion into the housing bore and may include an external groove formed thereon for capturing the canted coil spring in order to removably latch the insertion object within the bore of the housing. The canted coil spring may be a garter type canted coil spring that provides a radial force against the insertion object to complete the connection between the housing and the insertion object. Consequently, the contact point between the insertion object and the canted coil spring is made approximately in the middle between the two contact points made with the housing and the spring coil. This arrangement reduces the electrical conductive path from the housing to the insertion object to approximately 20-30% of the length of the spring coil. In other embodiments, the reduction is less than 20-30%, such as 10-19%. Still in other embodiments, the reduction is greater than 30%.

Figure 1A:
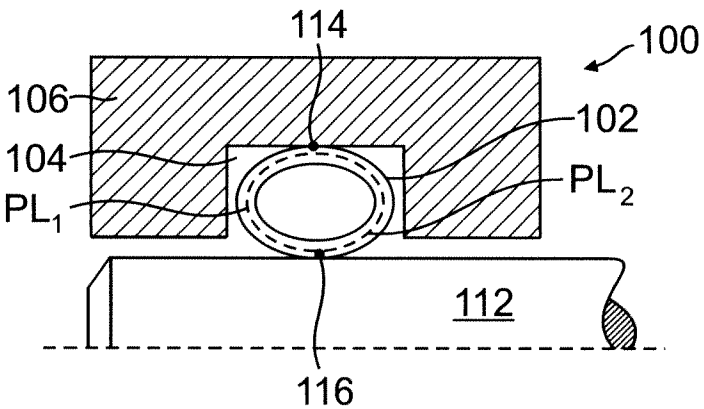
FIG. 1*a* is a simplified cross-sectional illustration showing a housing-mounted radial spring in a flat-bottom groove connector assembly.

FIG. 1*a* shows a canted coil radial spring connector assembly 100 where the spring 102 is mounted in a flat-bottom groove 104 of a housing 106. Typically in the connector assembly 100 comprising a radial canted coil spring, the width of the flat-bottom groove 104 of the housing 106 is larger than that of the major axis of a single spring coil. Therefore, the flat-bottom wall of the flat bottom groove 104 makes contact with spring coil. However, the side walls of the flat-bottom groove 104 do not make contact with the spring coil as the width is larger than the major axis. The electrical conductive path ($PL_1$ or $PL_2$) between an insertion object 112 and the housing 106 is the length of the spring coil, which is understood to be the physical length of each coil, from a first contact point 114 with the housing 106 and a second contact point 116 with the insertion object 112. In this embodiment, the first and second contact points 114 and 116 are on opposite ends of the spring coil. Thus, the conductive path length is half of the length of the spring coil ($\frac{1}{2}(PL_1+PL_2)$).

FIG. 1*b* shows a connector assembly 100*a* having a canted coil radial spring 102 mounted in a V-bottom groove 108 of a housing 110. As with the embodiment of the connector assembly 100 in FIG. 1*a*, the width of the V-bottom groove 108 of the housing 110 is larger than that of the major axis of a single spring coil. Therefore, the V shaped bottom wall of the V-bottom groove 108 makes contact with the spring coil at two contact points. However, the side walls of the V-bottom groove 108 do not make contact with the spring coil. Although, the connector assembly 100*a* provides an additional point of contact, i.e., a total of three contacts, between the spring coil and the housing, the electrical conductive path $PL_1$ or $PL_2$ remain almost half of the length of the spring coil because there is no contact with the side walls of the V-bottom groove.

Figure 2A:
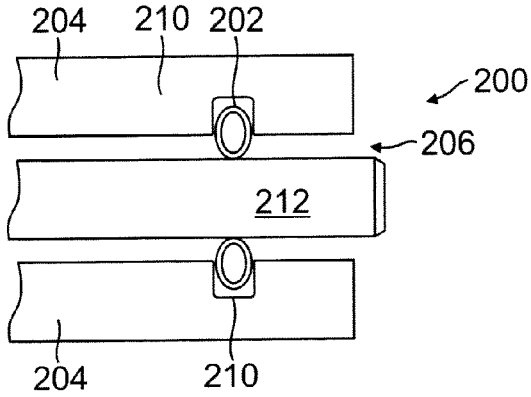
FIG. 2*a* is a simplified cross-sectional view of an electrical contact assembly in accordance with an embodiment.

FIG. 2*a* is a simplified cross-sectional view of an electrical contact assembly 200 in accordance with one embodiment of the disclosure. The contact assembly 200 includes an insertion object 212 projected into a housing 204 defining a bore 206 that extends through the housing. The bore 206 has an internal groove 210 formed within and around the bore 206. A canted coil spring 202 is located within the internal groove 210. In one embodiment, the canted coil spring 202 is an axial canted coil spring having a major axis and a minor axis and is configured to deflect along the minor axis in a manner discussed below. Generally speaking, all of the contact assembly embodiments may be used in either static, dynamic, or rotary applications including for electrical connectors, for mechanical connectors, and for medical connectors.

Figure 2B:
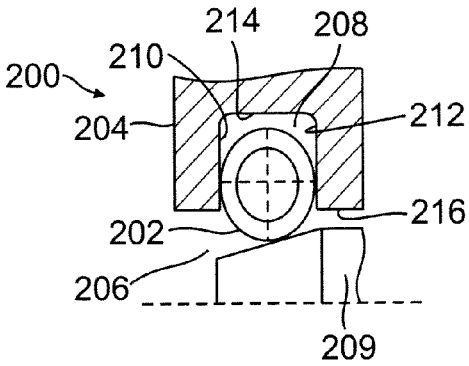
FIGS. 2*b* and 2*c* are simplified cross-sectional views showing a housing-mounted axially canted coil spring in a flat-bottom groove electrical contact assembly before and after insertion of an insertion object, respectively, in accordance with an embodiment.
Figure 2C:
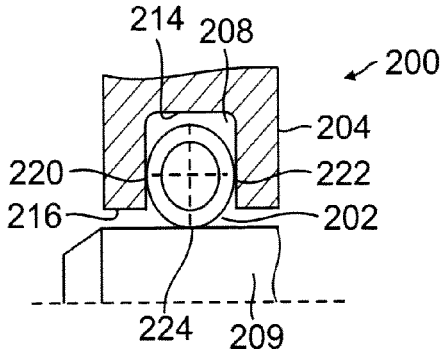

FIGS. 2*b* and 2*c* are simplified cross-sectional views showing the axially canted coil spring 202 in the electrical contact assembly 200 before and after insertion of the insertion object 209, respectively, in accordance with the embodiment of FIG. 2*a*. In this embodiment, the electrical contact assembly 200 includes a housing 204 defining a bore 206 formed through the housing configured to receive the insertion object 209. An internal channel or internal groove 208 is formed in the interior surface of the housing 204 around the bore 206. In this embodiment, the canted coil spring 202 is mounted in the internal groove 208, which has been formed having an extended flat-bottom wall.

In one embodiment, the axially canted coil spring 202 disposed within the internal groove 208 may be an axial, garter-type, canted coil spring. A garter type canted coil spring is a spring attached end-to-end which forms a spring loop to provide an inwardly directed clamping force when positioned around an object. Garter springs with round coils are designed to provide radial loads by deflecting the spring coils radially, thus providing the radial clamping force inward toward the center of the spring loop. As shown in FIG. 2*c*, which is the assembled position of the contact assembly 200 with the insertion object 209 inserted, the canted coil spring stretches radially further into the internal groove 208 upon connection. In response, the recoiling or rebounding effect of the canted coil spring 202 exerts an inwardly directed force on the insertion object 209 to hold and retain the insertion object 209 to the housing. In an alternative embodiment, the canted coil spring may be a non-garter axial canted coil spring. For example, the spring 202 may be made from one or more coil lengths placed inside the groove but do not have connected ends.

As shown in FIGS. 2*b* and 2*c*, the canted coil spring 202 is positioned within the internal groove 208. The internal groove 208 is defined by a first side wall 210 and a second side wall 212 that are orthogonal to a flat bottom wall 214 and extend outward therefrom to an open end 216. The side walls 210 and 212 are spaced apart the length of the opening 216, which represents the internal groove width. At least one spring coil of the canted coil spring 202 has a minor axis length that is greater than the width of the internal groove 208. Thus, since the axial canted coil spring 202 is configured to deflect in the direction perpendicular to the first side wall 210 and the second side wall 212, when placed into the internal groove 208, the canted coil spring 202 is retained in the internal groove 208 by a compression force. In some embodiments, the compression force may range from between 2% and 7% of the maximum compression force in order to retain the canted coil spring 202 in the internal groove 208. In other embodiments, the compression force is higher, such as 8% to 35%. Since the canted coil spring 202 is retained by contact with side walls 210 and 212, the depth of the internal groove 208 may be made to allow the canted coil spring 202 to be retained therein without making contact with the flat bottom wall 214. Thus, the groove 208 is extended in that the canted coil spring does not contact the bottom wall 214.

Creating a first contact point 220 between the first side wall 210 and the canted coil spring 202, a second contact point 222 between the second side wall 212 and the canted coil spring 202, and a third contact point 224 between the insertion object 209 and the canted coil spring 202 without making contact between the canted coil spring 202 and the flat bottom wall 214, reduces the electrical path resistance for electric flow between the insertion object and the housing as the length of the electrical conductive path is reduced. In one embodiment, the reduction in length of the electrical conductive path, which corresponds to the reduction in resistance, is on the order of about 50% of the full length of the spring coil. In other embodiments, the reduction of the length of the electrical path may range from between 20% to 50% and in some embodiments about 25% of the length of the spring coil. In physical terms, the electrical conductive path length equals to less than half (½) to about less than a quarter (¼) of a typical path length of a wire length of a single spring coil of a canted coil spring 202. Thus, an aspect of the present connector assembly is one that comprises a canted coil spring comprising a plurality of individual spring coils, and wherein the canted coil spring contacts an insertion object and two side walls of a housing groove but not the groove bottom wall to decrease the electrical path resistance of each individual spring coil. A further aspect of the present method is understood to include the steps of decreasing the electrical path resistance of an individual spring coil by contacting the spring coil against two side walls of a housing groove and the insertion object but not the groove bottom wall. This configuration reduces the electrical path length of the spring coil by about 20% to about 50% compared to when the spring coil contacts the groove bottom wall and insertion object at two polar opposite locations around the coil as shown in FIG. 1*a*.

The canted coil spring 202 may be a multi-metallic spring wire comprising various material layers. For example, the multi-metallic spring wire may be made from one of the wires disclosed in Ser. No. 12/511,518, entitled CANTED COIL MULTI-METALLIC WIRE, filed Jul. 29, 2009, the contents of which are expressly incorporated herein by reference for all purposes. The spring coils of the axial canted coil spring 202 may be mounted within the internal groove 208 in various shape configurations. For example, the spring coil shapes may be round, square, oval, rectangular, other polygonal shapes, and may be placed in a straight length configuration, i.e., not connected by the ends. By varying the shape of the spring coil, the actual area of contact between the spring coil and the housing or the insertion object may be controlled. The pin and housing configuration may also differ. For example, the pin may have a square shape configuration, a rectangular shape configuration, an oval shape configuration, other polygonal shape configurations, etc. and is configured to be inserted into a matching housing. Additionally, the housing may embody a straight length or a channel for inserting into by a square or rectangular pin. One of the sides of the channel would incorporate a canted coil spring having the shape and orientation as described elsewhere herein. The groove within the channel may also have various shaped configurations with both curved contours and angles wall surfaces, such as a base wall being positioned at a 65 degree angle with a side wall. Examples of canted coil spring designs may be found in commonly assigned U.S. Pat. No. 7,055,812 issued Jun. 6, 2006 to Balsells, which is expressly incorporated herein by reference.

Figure 2D:
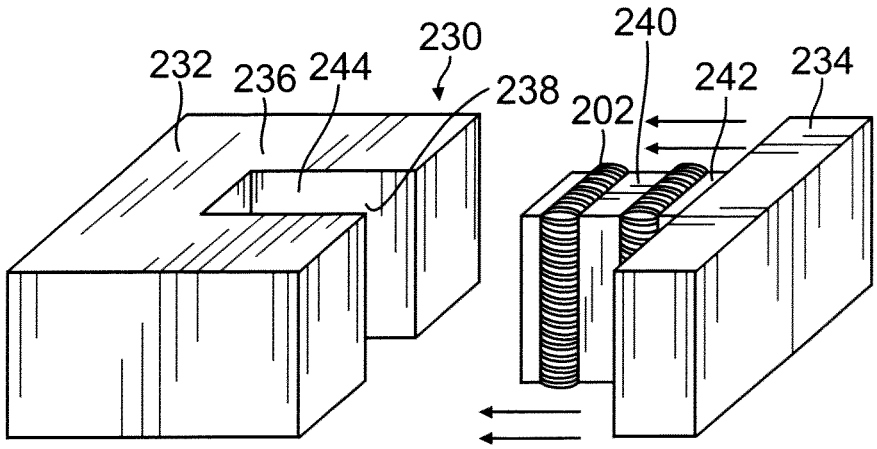
FIG. 2*d* is a perspective view of a electrical contact assembly that does not have a circular housing.

FIG. 2*d* discloses an alternative connector assembly comprising a channel housing 232 and pin assembly 234. The channel housing 232 comprises a body section 236 comprising an open channel 238 configured to receive the pin 240 of the pin assembly 234. The pin 240 comprises at least one pin groove 242 for receiving a canted coil spring 202, which may be an axial canted coil spring or a radial canted coil spring. As shown, the pin 240 comprises two grooves 242 and two canted coil springs 202. The springs 202 are rotated relative to the grooves 242 so that each spring, or at least one coil of each spring, contacts the groove at two points or locations. Thus, when the pin is inserted into the open channel 238, each spring 202 contacts each side wall 244 of the open channel 238 at a single point and contacts the respective groove 242 at two contact points. Thus, aspect of the present connector assembly is a housing and pin combination that is non-circular in configuration. The non-circular configuration also has reduced conductive paths by increasing the number of contact points between the springs 202 and the pin 240 and between the springs and the open channel.

Figure 2E:
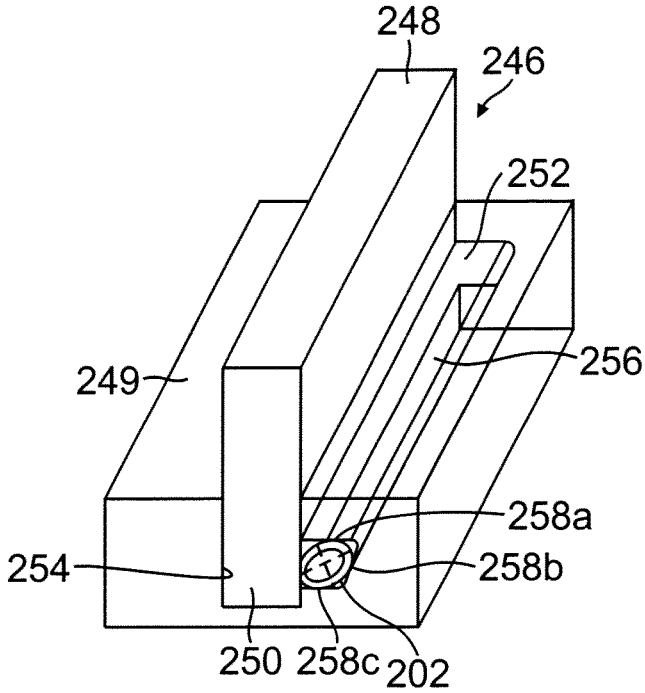
FIG. 2*e* is a perspective view of another electrical contact assembly that does not have a circular housing.

FIG. 2*e* discloses another alternative connector assembly 246 provided in accordance with a further aspect of the present invention. FIG. 2*e* shows part of the structure being transparent for discussion purposes only. As shown, the connector assembly comprises a plate connector 248 configured for insertion into a channel 250 of a channel housing 249, which comprises two channel sidewall 252, 254. As shown, sidewall 252 incorporates a groove 256 for accommodating a spring 202. In one embodiment, the groove is generally linear and extends along at least a portion of sidewall 252. Also as shown, the spring 202 is a canted coil spring that is linear, i.e., its ends are not connected. The canted coil spring may be an axial canted coil spring or a radial canted coil spring. In another example, sidewall 254 also has a groove and a canted coil spring disposed therein.

In use, the plate connector 248 is connected to a first electrical source and the housing 249 is connected to a second electrical source. When the plate connector 248 is inserted into the channel 250, the spring 202 contacts both the plate connector 248 and the housing 249 to close the electrical loop. In one embodiment, the spring 202 is positioned in the groove 256 in a way that reduces the lengths of the electrical paths compared to a spring mounted to contact the plate connector 248 at a single point and the groove 256 also at a single point. As shown, the spring 202 is mounted so that at least one spring coil of the plurality of spring coils contacts the groove at three contact points 258*a*, 258*b*, 258*c*. Thus, aspect of the present connector assembly is a housing and pin combination that is non-circular in configuration. A further feature of the present connector is a plate positioned in a channel of a channel housing, said channel comprising two sidewalls with at least one of the sidewalls comprising a groove and having a canted coil spring disposed therein; and wherein the contacts between the plate and the spring and between the spring and the groove have reduced contact paths compared to similar connector having a single point contact between the plate and the spring and between the spring and the groove.

Figure 3A:
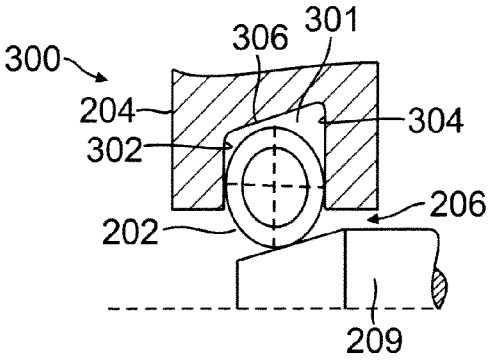
FIGS. 3*a* and 3*b* are simplified cross-sectional illustrations showing a housing-mounted axially canted coil spring in a tapered-bottom groove electrical contact assembly before and after insertion of an insertion object, respectively, in accordance with an embodiment.
Figure 3B:
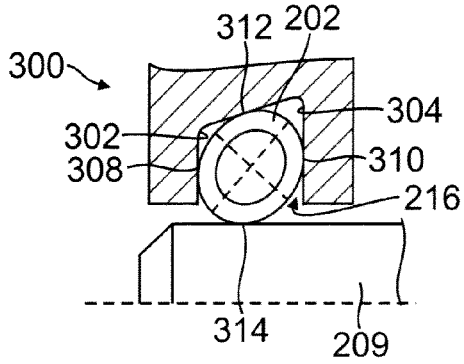

FIGS. 3*a* and 3*b* are simplified illustrations of a contact assembly 300 before and after insertion of the insertion object 209, respectively, in accordance with an embodiment of the present invention. The contact assembly 300 incorporates the features of the previously described embodiment of FIG. 2*a*-2*c*, with the exceptions noted below. The electrical contact assembly 300 includes the housing 204 defining the bore 206 formed through the housing and configured to receive the insertion object 209. In this embodiment, an internal groove 301 is defined by a first side wall 302 and a second side wall 304, which extend outward from the bottom wall to the open end 216 and are orthogonal to the axis of the insertion object 209. However, at least one of the side walls or both 302 and 304 are non-orthogonal to the bottom wall to form a tapered-bottom wall 306. The bottom wall 306 may be tapered as shown. i.e., has at least two different slopes or angled lines, or may be fully tapered with a single slope.

As before, to retain at least one spring coil of the canted coil spring 202 in the internal groove 301, the canted coil spring 202 has a minor axis length that is greater than the width of the internal groove 301. Thus, since the axial canted coil spring 202 is configured to deflect in the direction perpendicular to the first side wall 302 and the second side wall 304 when placed into the internal groove 301, the canted coil spring 202 is retained in the internal groove 301 by a compression force against the side walls.

In this embodiment, although the canted coil spring 202 is retained by contact with side walls 302 and 304, the canted coil spring 202 makes contact with at least a portion of the tapered-bottom wall 306. Operationally upon connection, as the canted coil spring 202 is forced into the internal groove 301, the tapered-bottom wall of the contact assembly 300 contacts the canted coil spring 202. The contact causes the canted coil spring 202 to rotate and be oriented at an angle relative to the angle of the tapered-bottom wall 306. For example, as shown in FIG. 3*b*, the canted coil spring 202 is initially inserted into the internal groove 301 with the major axis of the spring coil substantially parallel to the side walls 302, 304. As the canted coiled spring 202 is pushed deeper into internal groove 301, the spring contacts a portion of the tapered-bottom wall 306 causing the major axis of the spring coil to rotate into position.

When assemble, the canted coil spring 202 makes contact at four contact points: a first contact point 308 between the first side wall 302 and the canted coil spring 202, a second contact point 310 between the second side wall 304 and the canted coil spring 202, a third contact point 312 between the tapered-bottom wall 306 and the canted coil spring 202, and a forth contact point 314 between the insertion object 209 and the canted coil spring 202. Therefore, the electrical conductive path between the insertion object 209 and the housing 204 is reduced. In physical terms, the electrical conductive path length equals less than about 30% and in some embodiments less than about 25% of the entire wire length of the individual spring coil of the canted coil spring 202 thus improving conductivity and reducing heat buildup.

Figure 4A:
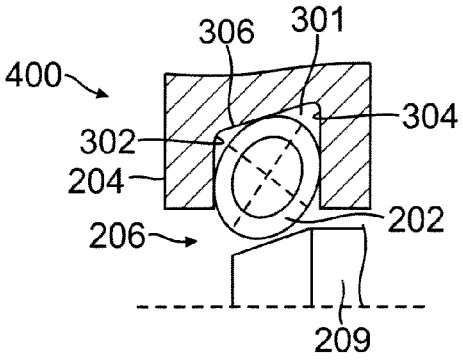
FIGS. 4*a* and 4*b* are simplified cross-sectional illustrations showing a housing-mounted axial spring positioned in a concave turn angle orientation for an electrical contact assembly before and after insertion of an insertion object, respectively, in accordance with an embodiment.
Figure 4B:
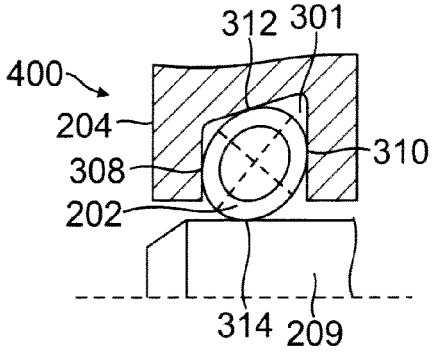

FIGS. 4*a* and 4*b* are simplified cross-sectional illustrations showing the axial canted coil spring 202 positioned in a concave turn angle orientation in an electrical contact assembly 400 before and after insertion of the insertion object 209, respectively, in accordance with an embodiment. The concave nomenclature is understood to mean an acute angle measured in a counterclockwise direction between the axis of the insertion object and the major axis of the spring coil. The contact assembly 400 incorporates the features of the previously described embodiments, with the exceptions noted below. In this embodiment, the axial canted coil spring 202 is pre-positioned prior to insertion of the insertion object 209 into the bore 206 and is mounted at a turn angle within internal groove 301 having the tapered-bottom wall 306. The first and second side walls 302 and 304 of internal groove 301 compress the canted coil spring 202 to retain the canted coil spring at a turn angle position within the internal groove 301. By positioning the canted coil spring 202 at a turn angle, the force required for insertion of the insertion object 209 through the spring is reduced as compared to turning the coil with the insertion object. Furthermore, the insertion force may be controlled by controlling the turn amount of the spring and/or the tapered end of the insertion object. Thus, as shown in FIG. 4*b*, the canted coil spring 202 is at a concave position relative to the insertion object's insertion direction, which lowers the insertion and running forces. However, advantageously the disconnection force may be higher than the connection force to make removal more difficult and therefore reduce inadvertent removal of the insertion object from the housing. As shown in FIG. 4*b*, the contact points 308, 310, 312, and 314 and the length of the electrical conductive path are similar to that of the embodiment of FIGS. 3*a* and 3*b*. Again, the insertion force, is lower due to the concave turn angle of the coil spring prior to inserting the insertion object.

Figure 5A:
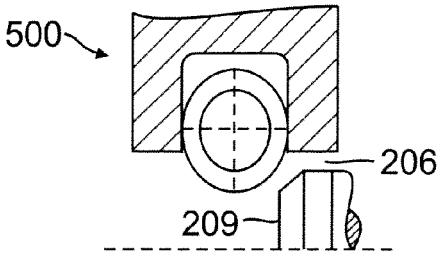
FIGS. 5*a* and 5*b* are simplified cross-sectional illustrations showing a housing-mounted axial garter spring in a flat-bottom groove electrical contact assembly before and after insertion of an insertion object, respectively, having an external groove for latching in accordance with an embodiment.
Figure 5B:
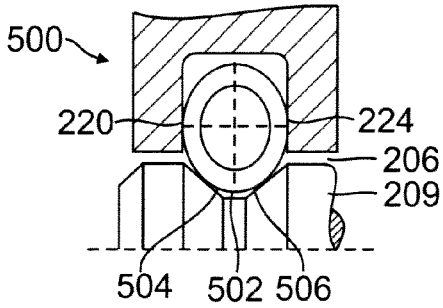

FIGS. 5*a* and 5*b* illustrate a contact assembly 500 similar to the contact assembly 200 shown in FIGS. 2*a*-2*c*, with the exceptions noted below. The contact assembly 500 as shown provides an additional latching capability. The latching capability is achieved by forming a V-bottom groove 502 externally on the insertion object 209. In this embodiment, upon insertion of the grooved insertion object 209 into the bore of the housing, the axial canted coil spring 202 is captured within the V-bottom groove 502 to latch or restrain the insertion object 209 within the bore 206. In addition, in contrast to contact assembly 200 shown in FIGS. 2*b* and 2*c*, the contact assembly 500 provides an additional contact point between the canted coil spring 202 and the insertion object 209. For example, when latched within the V-groove 502, the canted coil spring 202 contacts the V-bottom groove at two contact points 504 and 506, one on each leg of the V-bottom groove 502, further reducing the length of the electrical conductive path. Thus, a feature of the present assembly is understood to include a housing having a bore having an extended groove, a canted coil spring disposed within the extended groove such that the spring contacts the two side walls of the extended groove but not the groove bottom wall, and wherein an insertion object comprising an exterior V-bottom groove is positioned, at least in part, within the bore and contacts the canted coil spring at at-least two contact points along a spring coil. The two contact points with the V-bottom groove on the insertion object not only provide an additional contact point over a straight diameter shaft but also additional latching capability and further reduces the electrical path length to less than about 25% of the spring coil length. In the specific embodiment shown, each spring coil has four contact points—two with the housing groove and two with the pin groove.

Figure 6A:
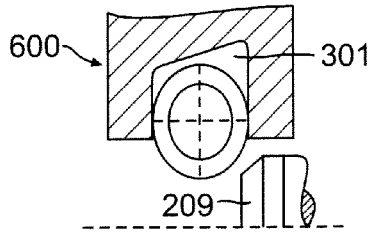
FIGS. 6*a* and 6*b* are simplified cross-sectional illustrations showing a housing-mounted axial garter spring in a tapered-bottom groove electrical contact assembly before and after insertion of an insertion object, respectively, having an external groove for latching in accordance with an embodiment.
Figure 6B:
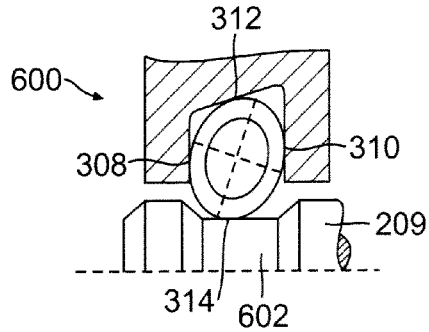

FIGS. 6*a* and 6*b* illustrate an embodiment of contact assembly 600 similar to the embodiment of contact assembly 300 shown in FIGS. 3*a* and 3*b*, with the exceptions noted below. As in the embodiment of FIGS. 3*a* and 3*b*, the canted axial spring 202 rotates within the internal groove 301 upon insertion of the insertion object 209. However, in this embodiment, the contact assembly 600 provides yet another embodiment of a latching capability. The latching capability is achieved by forming an external flat bottom groove 602 on the insertion object 209. In this embodiment, upon insertion of the grooved insertion object 209, the axial canted coil spring 202 is captured within the flat bottom groove 602 to latch or restrain the insertion object 209 within the bore 206. As with the contact assembly 300 shown in FIGS. 3*a* and 3*b*, the contact assembly 600 provides four contact points 308, 310, 312, and 314 to similarly reduce the length of the electrical conductive path. For example, the electrical conductive path length between points 314 to point 308 is about 20-30% of the spring coil's length, which improves conductivity due to lower resistance and thus reduces heat buildup as compared to conducting electricity along the entire length of the spring coil.

A further feature of the present assembly is understood to include a connector that increases contact points to reduce conductive path length of at least one spring coil of a canted coil spring. In one embodiment, the increase in contact points comprises a housing groove structured to allow rotation of the at least one sprig coil upon insertion of an insertion object. For example, the canted coil spring may be remote or spaced from the groove bottom wall prior to receiving the insertion object and then is forced against the groove bottom wall and rotated by the tapered bottom wall so that the coil now contacts the tapered bottom wall, the two side walls, and the surface of the insertion object.

Figure 7A:
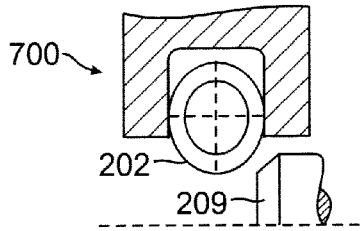
FIGS. 7*a* and 7*b* are simplified cross-sectional illustrations showing a housing-mounted axial garter spring in a flat bottom groove electrical contact assembly before and after insertion of an insertion object, respectively, having an external groove for locking in accordance with an embodiment.
Figure 7B:
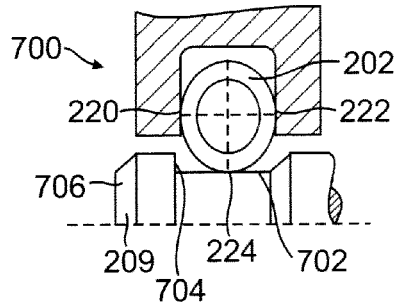

FIGS. 7*a* and 7*b* illustrate an embodiment of contact assembly 700 similar to the embodiment of contact assembly 200 shown in FIGS. 2*a*-2*c*. However, the contact assembly 700 provides a capability for locking the insertion object 209 within the bore 206. The locking capability may be achieved by forming an external locking groove 702 on the insertion object 209. The locking groove 702 is formed having at least one side wall 704 of the locking groove 702 be orthogonal to the center axis of the insertion object 209, thus preventing the insertion object 209 from being able to disconnect after insertion. As shown in FIG. 7*b*, the orthogonal side wall 704 on the locking groove 702 is on the distal end 706 of the insertion object 209, thus preventing the insertion object 209 from disconnecting in the opposite or proximal direction, i.e., to the right of FIG. 7*b*, relative to the orthogonal side wall 704. The contact assembly 700 provides three contact points 220, 222 and 224 and a reduction in electrical conductive path similar to the embodiment of FIGS. 2*b* and 2*c*.

Figure 8A:
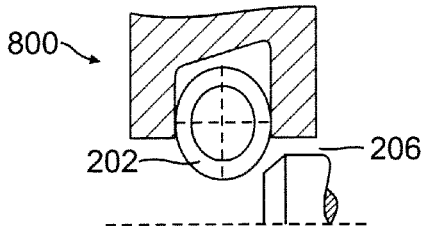
FIGS. 8*a* and 8*b* are simplified cross-sectional illustrations showing a housing-mounted axial garter spring in a tapered-bottom groove electrical contact assembly before and after insertion of an insertion object, respectively, having an external grove for locking in accordance with an embodiment.
Figure 8B:
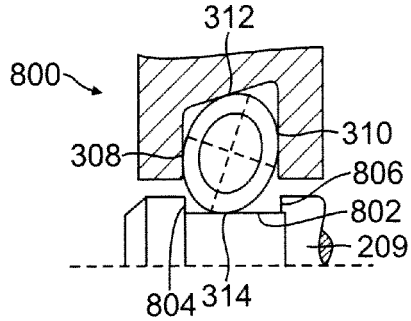

FIGS. 8*a* and 8*b* illustrate an embodiment of contact assembly 800 similar to the embodiment of contact assembly 300 shown in FIGS. 3*a* and 3*b*, with the exceptions indicated below. In the present embodiment, the contact assembly 800 provides a locking capability similar to the embodiment of FIGS. 7*a* and 7*b* using a locking groove 802 on the insertion member 209. However, as shown in FIG. 8*b*, in this embodiment, the locking groove 802 includes a first orthogonal side 804 and a second orthogonal side 806 on opposed side walls of the locking groove 802. The locking groove 802 locks the insertion object 209 in position within bore 206. The assembly 800 provides four contact points 308, 310, 312 and 314 and an electrical conductive path similar to the embodiment of FIGS. 6*a* and 6*b*.

Figure 9A:
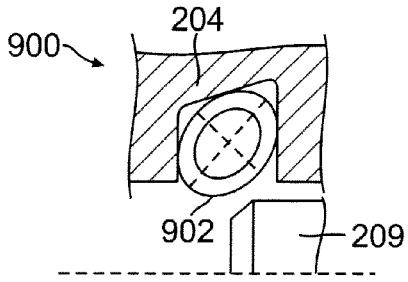
FIGS. 9*a* and 9*b* are simplified cross-sectional illustrations showing a housing-mounted radial canted coil spring in a tapered-bottom groove connector assembly before and after insertion of an insertion object, respectively, in accordance with an embodiment.
Figure 9B:
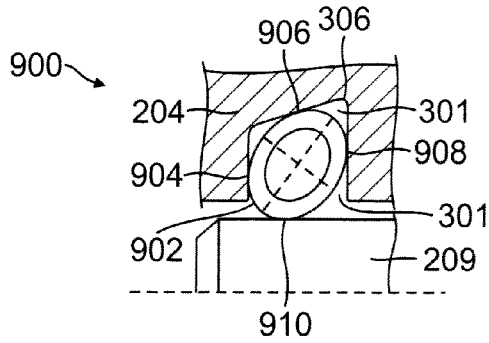

FIGS. 9*a* and 9*b* are simplified cross-sectional illustrations showing contact assembly 900 before and after insertion of the insertion object 209, respectively, in accordance with an embodiment. In this embodiment, the canted coil spring is a radial canted coil spring 902 mounted in the internal groove 301 having a tapered-bottom wall 306 of the housing 204. However, an axial canted coil spring may be used with the contact assembly without deviating from the spirit and scope of the present invention. The length of the groove width of the internal groove 301 is less than the major axis of the radial canted coil spring 902. Thus, to position the radial canted coil spring 902 within the internal groove 301, it is turned at an appropriate turn angle orientation upon insertion of the radial spring into the internal grove 301 to fit the geometry of the internal groove. In FIG. 9*a*, the radial canted coil spring 902 is oriented in a concave turn angle relative to the insertion direction of the insertion object 209. Consequently, this provides a lower force required for inserting the insertion object and a lower running force. FIG. 9*b* shows the assembled position of the contact assembly 900 with the insertion object inserted. The assembly provides three contact points 904, 906, 908 between the radial canted coil spring 902 and the individual spring coils and the housing 204 and a fourth contact point 910 between the housing 204 and the insertion object 209. The electrical conductive path between the insertion object 209 and the housing 204 is approximately a quarter (¼) of the length of the single spring coil, which provides improved conductivity, reduction in heat buildup, and high current carrying capabilities.

Figure 10A:
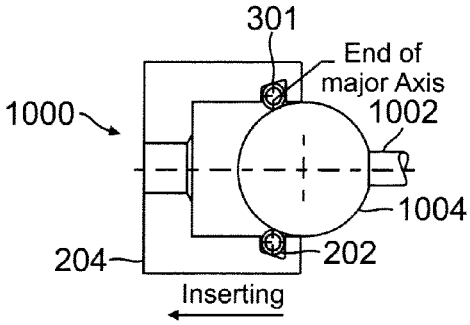
FIGS. 10*a* and 10*b* are simplified cross-sectional illustrations showing a housing-mounted axial spring in a tapered-bottom groove electrical contact assembly with an insertion object having a spherically shaped insertion end before and after insertion of the insertion object, respectively, in accordance with an embodiment.

FIG. 10*a* is a simplified illustration of a canted coil axial spring contact assembly 1000 before insertion of an insertion object 1002 where the canted coil spring 202 is mounted in a tapered-bottom wall internal groove 301 of the housing 204. Before insertion of the insertion object 1002, the spring 202 is orientated at a first position. In this embodiment, the insertion object 1002 is a shaft having a spherically shaped insertion end 1004.

Figure 10B:
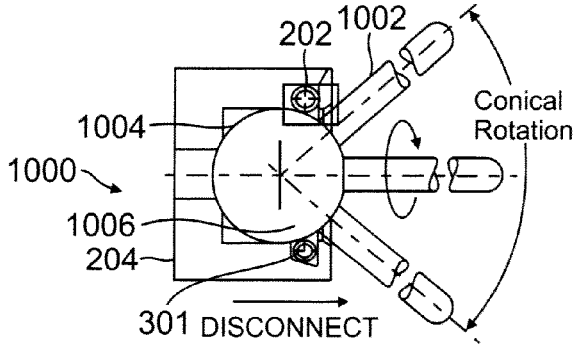

FIG. 10*b* is a simplified illustration of the contact assembly 1000 of FIG. 10*a* in the assembled position, which shows the spring 202 oriented in a second position. As shown in FIG. 10*b*, the insertion object 1002 with the spherically shaped insertion end 1004, once inserted into the bore 206, allows for a conical rotation of the insertion object 1002 when retained within the housing 204. For each rotated position, the insertion object 1002 can also rotate about an axis defined by the shaft. In this embodiment, the contact assembly 1000 has three contact points 308, 310 and 312 and a fourth contact point 1006 between the spherically shaped insertion end 1004 and the canted coil spring 202, and a reduction in the length of the electrical conductive path similar to that of contact assembly 300 of FIGS. 3*a* and 3*b*.

Figure 11:
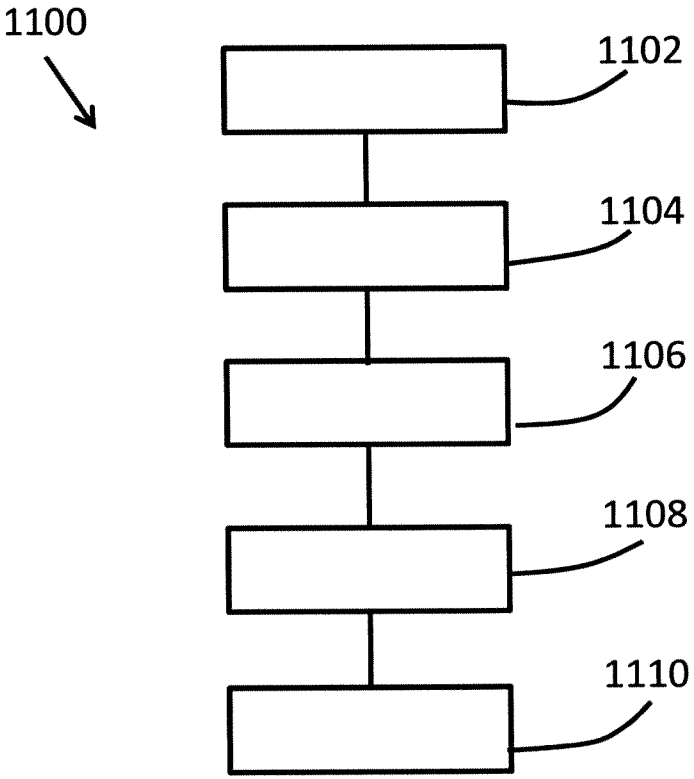
FIG. 11 is a process flow diagram depicting a method for improving electrical transmission through an electrical contact assembly.

FIG. 11 is a process flow diagram depicting a method for improving electrical transmission through an electrical contact assembly, which is generally designated 1100. In the example shown, the method is implemented using a connector comprising an insertion object having a longitudinal axis, a housing having a bore receiving the insertion object therein, and plurality of coils of a canted coil spring in electrical communication with the housing and the insertion object. The insertion object can be a pin, a shaft or a rod, as discussed above.

As shown, the method comprises the step of reducing electrical resistance between the housing and the insertion object at 1102. In an example, this is performed by providing an electrical path length between a first contact point, defined by a contact between the insertion object and a coil that contacts the insertion object, and a second contact point, defined by a contact point between the housing and the coil that contacts the insertion object. At 1104, the method involves reducing the electrical path length by about 10% to 50% compared to a direct path length of two contact points located along a line that is orthogonal to the longitudinal axis of the insertion object.

At 1106, the method calls for providing a groove in the bore of the housing or on the insertion object, said groove having two generally parallel side walls and a bottom wall located between the two generally parallel side walls. At 1108, the method further includes the step of providing an axial canted coil spring for the canted coil spring in the groove. Finally, the method of improving electrical transmission through an electrical contact assembly includes the step at 1110 of biasing the axial canted coil spring against the two generally parallel side walls of the groove but spaced from the bottom wall to define two contacts for each contacting coil with the groove, the two contacts for each contacting coil with the groove increase a number of contacts for each contacting coil with the groove from a single contact with the bottom wall to two contacts with the two generally parallel side walls.

Figure 12:
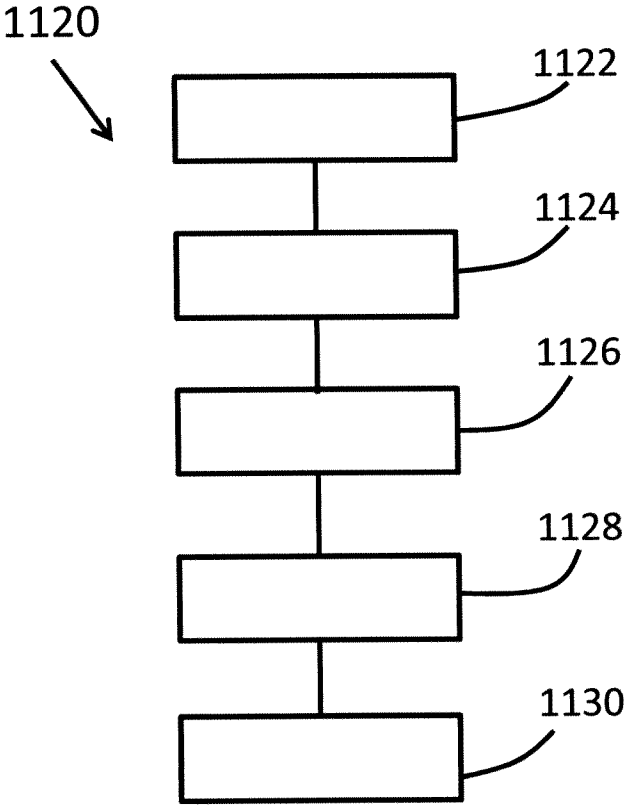
FIG. 12 is a process flow diagram depicting a method for decreasing heat buildup through an electrical contact assembly.

With reference now to FIG. 12, a process flow diagram depicting a method for decreasing heat buildup through an electrical contact assembly, which is generally designated 1120. In the example shown, the method is implemented using an electrical contact assembly comprising an insertion object having a longitudinal axis, a housing having a bore receiving the insertion object therein, and plurality of coils of a canted coil spring electrical communication with the housing and the insertion object by contacting the housing.

As shown, the method comprises the step of providing a conductive axial canted coil spring for the canted coil spring comprising a major axis and a minor axis defining a coil width measured along the minor axis at 1122. At 1124, the method comprises the step of reducing electrical resistance between the housing and the insertion object through the axial canted coil spring by providing an electrical path length between a first contact point, defined by a contact between the insertion object and a coil that contacts the insertion object, and a second contact point, defined by a contact point between the housing and the coil that contacts the insertion object. At 1126, the method comprises the step of reducing the electrical path length by about 10% to 50% compared to a direct path length of two contact points located along a line that is orthogonal to the longitudinal axis of the insertion object.

At 1128, the method comprises the step of providing a groove in the bore of the housing or on the insertion object, said groove having two generally parallel side walls defining a groove width and a bottom wall located between the two generally parallel side walls. At 1130, the method comprises the step of biasing the axial canted coil spring against the two generally parallel side walls of the groove but spaced from the bottom wall to define two contacts for each contacting coil with the groove, the two contacts for each contacting coil with the groove increase a number of contacts for each contacting coil with the groove from a single contact with the bottom wall to two contacts with the two generally parallel side walls. In the example shown, the coil width is larger than the groove width.

Although there have been hereinabove described electrical contact assemblies for purposes of illustrating the manner in which the embodiments may be constructed and used, it should be appreciated that the disclosure is not limited thereto. Accordingly, any and all modifications, variations or equivalent arrangements, which may occur to those skilled in the art, should be considered to be within the scope of the present disclosure as defined in the appended claims. For example, while axial canted coil springs are disclosed for use with the connector assemblies discussed hereinabove, radial springs may also be used by turning the coils. As another example, the housing and the pin may be connected to different sources for electrical transmission between the two. The canted coil spring, which contacts both the spring and the housing, provides a closed-loop between the pin and the housing. As the connector is designed for electrical transmission, the housing, the spring, and the pin, or at least an insert in each of the housing and the pin, are made of an electrically conductive material. Furthermore, while specific features may be disclosed for one embodiment, they are equally applicable to other embodiments even though not expressly discussed provided the features are compatible and do not conflict.

What is claimed is:

1. A method of improving electrical transmission through an electrical contact assembly comprising an insertion object having a longitudinal axis, a housing having a bore receiving the insertion object therein, and plurality of coils of a canted coil spring in electrical communication with the housing and the insertion object, the method comprising:

reducing electrical resistance between the housing and the insertion object by providing an electrical path length between a first contact point, defined by a contact between the insertion object and a coil that contacts the insertion object, and a second contact point, defined by a contact point between the housing and the coil that contacts the insertion object, reducing the electrical path length by about 10% to 50% compared to a direct path length of two contact points located along a line that is orthogonal to the longitudinal axis of the insertion object by:

providing a groove in the bore of the housing or on the insertion object, said groove having two generally parallel side walls and a bottom wall located between the two generally parallel side walls; and providing an axial canted coil spring for the canted coil spring in the groove; and biasing the axial canted coil spring against the two generally parallel side walls of the groove but spaced from the bottom wall to define two contacts for each contacting coil with the groove, the two contacts for each contacting coil with the groove increase a number of contacts for each contacting coil with the groove from a single contact with the bottom wall to two contacts with the two generally parallel side walls.

2. The method of claim 1, wherein the electrical path length between the first contact point and the second contact point defines a shortest electrical path length between the housing and the insertion object.

3. The method of claim 1, wherein the groove is located in the bore of the housing and the insertion object comprises a groove comprising two side walls and a bottom wall located between the two side walls.

4. The method of claim 1, wherein the bottom wall of the groove is V-shaped.

5. The method of claim 1, wherein the groove is located in the bore of the housing.

6. The method of claim 5, further comprising a groove on the insertion object contacting the axial canted coil spring.

7. The method of claim 1, wherein the electrical path length between the first contact point and the second contact point is about 30% to 50% of the direct path length.

8. The method of claim 1, wherein the plurality of coils are selected from a group consisting of round, square, oval, and rectangular shaped spring coils.

9. The method of claim 1, further comprising positioning the canted coil spring at a concave turn angle orientation relative to an insert direction of the insertion object prior to inserting the insertion object into the bore of the housing.

10. The method of claim 1, wherein the spring coil is shaped to provide an increased contact area at the first contact point and the second contact point.

11. The method of claim 1, wherein the canted coil spring comprises a spring length comprising two un-connected ends.

12. The method of claim 1, wherein the canted coil spring comprises a multi-metallic spring wire comprising two or more material layers.

13. A method of decreasing heat buildup through an electrical contact assembly comprising an insertion object having a longitudinal axis, a housing having a bore receiving the insertion object therein, and plurality of coils of a canted coil spring electrical communication with the housing and the insertion object by contacting the housing, the method comprising:

providing a conductive axial canted coil spring for the canted coil spring comprising a major axis and a minor axis defining a coil width measured along the minor axis;

reducing electrical resistance between the housing and the insertion object through the axial canted coil spring by providing an electrical path length between a first contact point, defined by a contact between the insertion object and a coil that contacts the insertion object, and a second contact point, defined by a contact point between the housing and the coil that contacts the insertion object, reducing the electrical path length by about 10% to 50% compared to a direct path length of two contact points located along a line that is orthogonal to the longitudinal axis of the insertion object by:

providing a groove in the bore of the housing or on the insertion object, said groove having two generally parallel side walls defining a groove width and a bottom wall located between the two generally parallel side;

biasing the axial canted coil spring against the two generally parallel side walls of the groove but spaced from the bottom wall to define two contacts for each contacting coil with the groove, the two contacts for each contacting coil with the groove increase a number of contacts for each contacting coil with the groove from a single contact with the bottom wall to two contacts with the two generally parallel side walls; and wherein the coil width is larger than the groove width.

14. The method of claim 13, wherein the insertion object has a V-groove.

15. The method of claim 13, wherein the insertion object has a tapered insertion end.

16. The method of claim 13, wherein the bottom wall of the groove is V-shaped.

17. The method of claim 13, wherein the electrical path length between the first contact point and the second contact point is about 30% to 50% of the direct path length of a coil of the plurality of coils.

18. The method of claim 13, wherein the plurality of coils are selected from a group consisting of round, square, oval, and rectangular shaped spring coils.

19. The method of claim 13, wherein the canted coil spring is positioned at a concave turn angle orientation relative to an insert direction of the insertion object prior to contacting the insertion object.

20. The method of claim 13 therein the canted coil spring comprises a multi-metallic spring wire comprising two or more material layers.

* * * * *

UNITED STATES PATENT AND TRADEMARK OFFICE

CERTIFICATE OF CORRECTION

PATENT NO. : 8,491,345 B2
APPLICATION NO. : 13/453944
DATED : July 23, 2013
INVENTOR(S) : Gordon Leon et al.

It is certified that error appears in the above-identified patent and that said Letters Patent is hereby corrected as shown below:

On the Title Page, Item (73), in column 1, line 1, Delete "Enginnering" and insert -- Engineering --, therefor.

In the Specification

In column 1, line 8, Delete "20120" and insert -- 2010 --, therefor.

In the Claims

In column 13, line 4, In Claim 1, delete "walls; and" and insert -- walls; --, therefor.

In column 14, line 22, In Claim 13, delete "side;" and insert -- side walls; --, therefor.

In column 14, line 42-43, In Claim 17, delete "length of a coil of the plurality of coils." and insert -- length. --, therefor.

In column 14, line 52, In Claim 20, delete "13 therein" and insert -- 13, wherein --, therefor.

Signed and Sealed this
Twenty-sixth Day of August, 2014

Michelle K. Lee

Michelle K. Lee
*Deputy Director of the United States Patent and Trademark Office*